US009827648B2

(12) United States Patent
Miyauchi et al.

(10) Patent No.: US 9,827,648 B2
(45) Date of Patent: Nov. 28, 2017

(54) ROLLER BURNISHING TOOL DEVICE

(71) Applicant: SUGINO MACHINE LIMITED, Uozu-shi, Toyama (JP)

(72) Inventors: Shinya Miyauchi, Uozu (JP); Masaru Futamura, Uozu (JP)

(73) Assignee: Sugino Machine Limited, Toyama (JP)

( * ) Notice: Subject to any disclaimer, the term of this patent is extended or adjusted under 35 U.S.C. 154(b) by 231 days.

(21) Appl. No.: 14/746,967

(22) Filed: Jun. 23, 2015

(65) Prior Publication Data

US 2015/0367479 A1 Dec. 24, 2015

(30) Foreign Application Priority Data

Jun. 24, 2014 (JP) ..... 2014-129287

(51) Int. Cl.
*B24B 39/00* (2006.01)
*B24B 39/02* (2006.01)

(52) U.S. Cl.
CPC ..... *B24B 39/00* (2013.01); *B24B 39/023* (2013.01); *Y10T 29/471* (2015.01)

(58) Field of Classification Search
CPC ..... B24B 39/02; B24B 39/023; B21C 37/30
USPC ..... 29/90.01
See application file for complete search history.

(56) References Cited

U.S. PATENT DOCUMENTS 2,835,958 A * 5/1958 Mock ..... B24B 39/023 29/90.01
3,069,750 A * 12/1962 Koppelmann ..... B24B 39/023 29/90.01
3,099,070 A * 7/1963 Morrison ..... B24B 39/023 72/126
3,130,477 A * 4/1964 Gill ..... B24B 39/023 29/90.01
3,555,643 A * 1/1971 Koppelmann ..... B24B 39/023 29/90.01
3,751,781 A * 8/1973 Koppelmann ..... B24B 39/023 29/90.01

(Continued)

FOREIGN PATENT DOCUMENTS

EP 0503109 A1 9/1992
JP 3245638 B2 1/2002

OTHER PUBLICATIONS

Extended European Search Report dated Dec. 9, 2015 corresponding to European Patent Application No. 5173626.1.

*Primary Examiner* — Christopher M Koehler
(74) *Attorney, Agent, or Firm* — Carrier Blackman & Associates, P.C.; William D. Blackman; Jingli Wang

(57) ABSTRACT

Provided is a roller burnishing tool device including a shank; a housing connected to the shank, a connected position of the housing relative to the shank being adjustable; a roller support member supported to be capable of rotating relative to the housing and attached to follow a movement of the housing in a case of adjusting the connected position; tapered rollers supported by the roller support member; a mandrel having a tapered portion matched with the tapered rollers and movable relative to the roller support member; and a tool diameter following mechanism connecting the shank and the mandrel, having a lead groove formed spirally in a front portion of the shank, a pin member capable of moving along the lead groove, a pin member insertion hole formed in the mandrel to insert the pin member therein, and a biasing unit biasing the mandrel forward.

3 Claims, 3 Drawing Sheets

(56) References Cited

U.S. PATENT DOCUMENTS

| | | | | | |
|---|---|---|---|---|---|
| 3,840,957 | A * | 10/1974 | Koppelmann | ..... | B24B 39/023 29/90.01 |
| 4,542,565 | A * | 9/1985 | Berstein | ..... | B24B 39/023 29/90.01 |
| 2002/0046451 | A1 * | 4/2002 | Okeda | ..... | B24B 39/023 29/90.01 |

* cited by examiner

ROLLER BURNISHING TOOL DEVICE

CROSS REFERENCE TO RELATED APPLICATION

This application claims the foreign priority benefit under Title 35, United States Code, 119 (a)-(d) of Japanese Patent Application No. 2014-129287, filed on Jun. 24, 2014 in the Japan Patent Office, the disclosure of which is herein incorporated by reference in its entirety.

BACKGROUND OF THE INVENTION

1. Technical Field

The present invention relates to a roller burnishing tool device, especially to a roller burnishing tool device equipped with a tool diameter following mechanism.

2. Description of Background Art

A roller burnishing tool device is a device which presses a roller or rollers, while rotating the roller or the rollers, onto a workpiece, for example, onto an inner surface of a cylindrical hole of the workpiece, to plastically deform and finish the surface to be a mirror surface. The finishing by using the roller burnishing tool device is affected by a variation of the diameter of the hole to be processed or a difference of several tens of microns (μm) in setting a tool diameter. Note that, in this specification, the variation is a variation among hole diameters of holes of workpieces to be processed, or a variation among hole diameters at positions in a hole of a workpiece to be processed in the axial direction of the hole. Hereinafter, these two types of hole diameters are sometimes called as an inner diameter (of an inner surface of a workpiece) or a hole diameter (of a workpiece) without distinction. Therefore, there is known a roller burnishing tool device equipped with an adjustment spring mechanism and a displacement mechanism, which device is capable of automatically coping with the variation of a hole diameter (following a tool diameter) (for example, the patent literature 1).

The roller burnishing tool device described in the patent literature 1 is controlled by the adjustment spring mechanism so that a change of a rotational load torque acting on the displacement mechanism is kept in a prescribed set value. The displacement mechanism is equipped with a roller unit disposed between a shank and a driver. The driver is moved in an axial direction relative to the shank by the change of the rotational load torque by utilizing a feed mechanism with a feed angle and a planetary motion of flexible rollers of the roller unit. Thus the roller burnishing tool device is capable of coping with the variation.

Patent literature 1: Japanese Patent No. 3245638, B (paragraphs 0044 to 0054, FIG. 1, FIG. 3)

BRIEF SUMMARY OF THE INVENTION

However, in the roller burnishing tool device described in the patent literature 1, the displacement mechanism is disposed in the housing, so that the structure of the housing is complex and the outer size of the housing is large. Therefore, there has been a problem that an attachable processing machine is restricted.

Furthermore, the flexible rollers are consumable ones and an exchange of the flexible rollers is necessary. Nevertheless, there has been a problem that maintenance is hard to be performed because the structure of the housing is complex.

The present invention has been created in view of such a technical background. It is an object of the present invention to provide a roller burnishing tool device the structure of which is simplified to reduce the number of parts, to be downsized, and to improve workability in maintaining, and which is equipped with a tool diameter following mechanism.

To solve the above problems, the present invention provides a roller burnishing tool device including:

- a shank to be attached to a processing machine;
- a housing connected to the shank, a connected position of the housing relative to the shank being adjustable in a front-rear direction;
- a roller support member having an annular shape in a cross section thereof, supported so as to be capable of rotating relative to the housing, and disposed so as to follow a movement of the housing in a case where the connected position of the housing relative to the shank is adjusted to be changed;
- rollers having tapered shapes and supported by the roller support member;
- a mandrel having a tapered portion matched with the tapered shapes of the rollers and inserted in the roller support member coaxially; and
- a tool diameter following mechanism connecting the shank and the mandrel, the tool diameter following mechanism including:
  - a hollow cylindrical portion formed at a front portion of the shank,
  - a lead groove formed spirally in the hollow cylindrical portion,
  - a pin member disposed so as to be capable of moving spirally along the lead groove,
  - a pin member insertion hole formed in the mandrel, which hole the pin member is inserted in, and
  - a biasing unit attached to the shank and biasing the mandrel forward.

The present invention includes the tool diameter following mechanism. So by the tool diameter following mechanism, the rotational load torque and the axial force of the mandrel are balanced to be capable of automatically adjusting the pressing force in burnishing. Namely, the pressing force in burnishing can be kept to be a proper pressing force by flexibly coping with variations of the inner diameter of a workpiece to automatically adjust a tool diameter. As a result, a uniform finished surface can be made.

Furthermore, a plateau surface excellent in sliding characteristics can be easily made. Burnishing can make a mirror finish by crushing convex portions on a concavo-convex surface with rollers. However in a case of making a surface excellent in sliding characteristics, it is necessary to form ideal concavo and convex portions on a surface. Sizes of concavo and convex portions are largely changed when quantity to be burnished, that is, quantity of burnishing, changes by several microns (μm). The size of an inner diameter of a hole of a workpiece before being burnished by using rollers has a variation generally in micron order for machine parts (workpieces) mass-produced with a dimensional tolerance equal to or more than several microns. Therefore, processing of burnishing having a constant quantity of burnishing has not been able to be performed, so that forming concavo and convex portions having constant sizes has been hard. However, according to the present invention, quantity of burnishing can be kept to be constant by using the tool diameter following mechanism even in a case where a hole diameter varies. Therefore, constant concavo and convex portions, that is, a good plateau surface can be steadily made.

Thus a plateau surface can be made for a machine part which needs good sliding characteristics by using the roller burnishing tool device according to the present invention. So sliding performance of the machine part can be improved.

The present invention includes the lead groove formed spirally in the hollow cylindrical portion formed at the front portion of the shank, and the shank and the mandrel are connected with the pin member disposed so as to be capable of moving spirally along the lead groove to constitute the main portion of the tool diameter following mechanism. Thus the tool diameter following mechanism can be housed in the shank. So the outer dimensions of the housing can be formed to be small, so that the whole of the tool device can be miniaturized.

Thus the roller burnishing tool device according to the present invention is easily handled and the operability thereof is improved, and furthermore, the range of applying the tool device can be enlarged, so that the tool device can be applied to various processing machines.

Furthermore, it is not needed to house flexible rollers in the housing. Therefore, the constitution of the housing can be simplified to reduce the number of parts and consumables, and to improve assembly and disassembly performance.

Furthermore, it is preferable that the roller burnishing tool device further includes a biasing force adjusting tool to adjust biasing force of the biasing unit.

According to the above preferable constitution, the present invention includes the biasing force adjusting tool, so that the pressing force in burnishing can be properly adjusted. Therefore, a uniformly finished surface can be made.

The roller burnishing tool device according to the present invention simplifies the constitution thereof to reduce the number of parts and to be miniaturized. Furthermore, maintenance performance can be improved and a uniformly finished surface can be made.

DETAILED DESCRIPTION OF THE INVENTION

A roller burnishing tool device according to an embodiment of the present invention will be described in detail appropriately with reference to the attached drawings.

Figure 1:
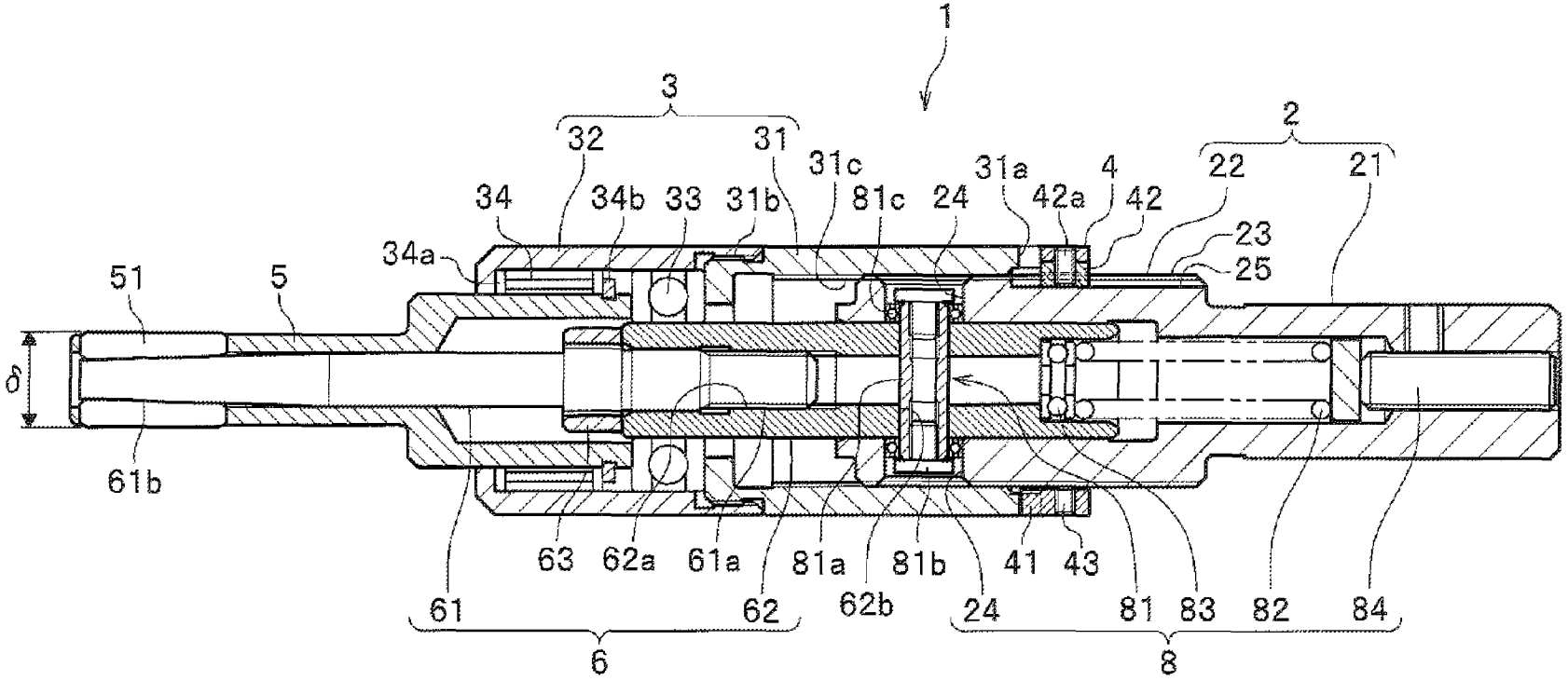
FIG. 1 is a longitudinal sectional view showing the structure of a roller burnishing tool device according to an embodiment of the present invention.

As shown in FIG. 1, the roller burnishing tool device 1 is equipped with a shank 2, a housing 3, an adjustment ring 4, a frame 5, a plurality of tapered rollers 51, a mandrel 6, and a tool diameter following mechanism 8. The shank 2 is to be attached to a processing machine (not shown) to be rotated. The housing 3 is connected to the shank 2. The adjustment ring 4 connects the shank 2 and the housing 3. The frame 5 is a roller support member to support the tapered rollers 51, and a hollow member with an annular shape (circle) in a cross section thereof. The tapered rollers 51 are supported to rotate by the roller support member 5. The mandrel 6 has a tapered portion 61*b* matched with the tapered shape of each of the tapered rollers. The tool diameter following mechanism 8 connects the shank 2 and the mandrel 6 to automatically adjust the pressing force in processing.

"Matching" in this specification means that each of the tapered rollers and the tapered portion of the mandrel come into contact with each other in the state of line-contacting. In some cases, each tapered roller 51 comes into contact with an inner surface of a cylindrical hole of a workpiece in the state of point-contacting, and in some cases, each tapered roller 51 comes into contact with an inner surface of a cylindrical hole of a workpiece in the state of line-contacting. For example, a case in which a tapered angle of each tapered roller 51 is as half in size as a tapered angle of the tapered portion 61*b* of the mandrel 6 is a case in which each tapered roller 51 comes into contact with the tapered portion 61*b* of the mandrel 6 in the state of line-contacting, and also comes into contact with an inner surface of a cylindrical hole of a workpiece in the state of line-contacting.

Note that, in the present embodiment, a use mode in which the shank 2 is attached to a processing machine (not shown) to be rotated will be explained as an example, but the present invention is not limited to this form. The processing can be performed even where the shank 2 is fixed to the processing machine (not shown) and a workpiece (not shown) is rotated.

For convenience of the following explanation, a shank 2 side (a right side in FIG. 1) is called as a rear side portion or rear, and a roller 51 side (a left side in FIG. 1) is called as a front side portion or front. A front direction and a rear direction are determined like that also for each constituent member.

Figure 2:
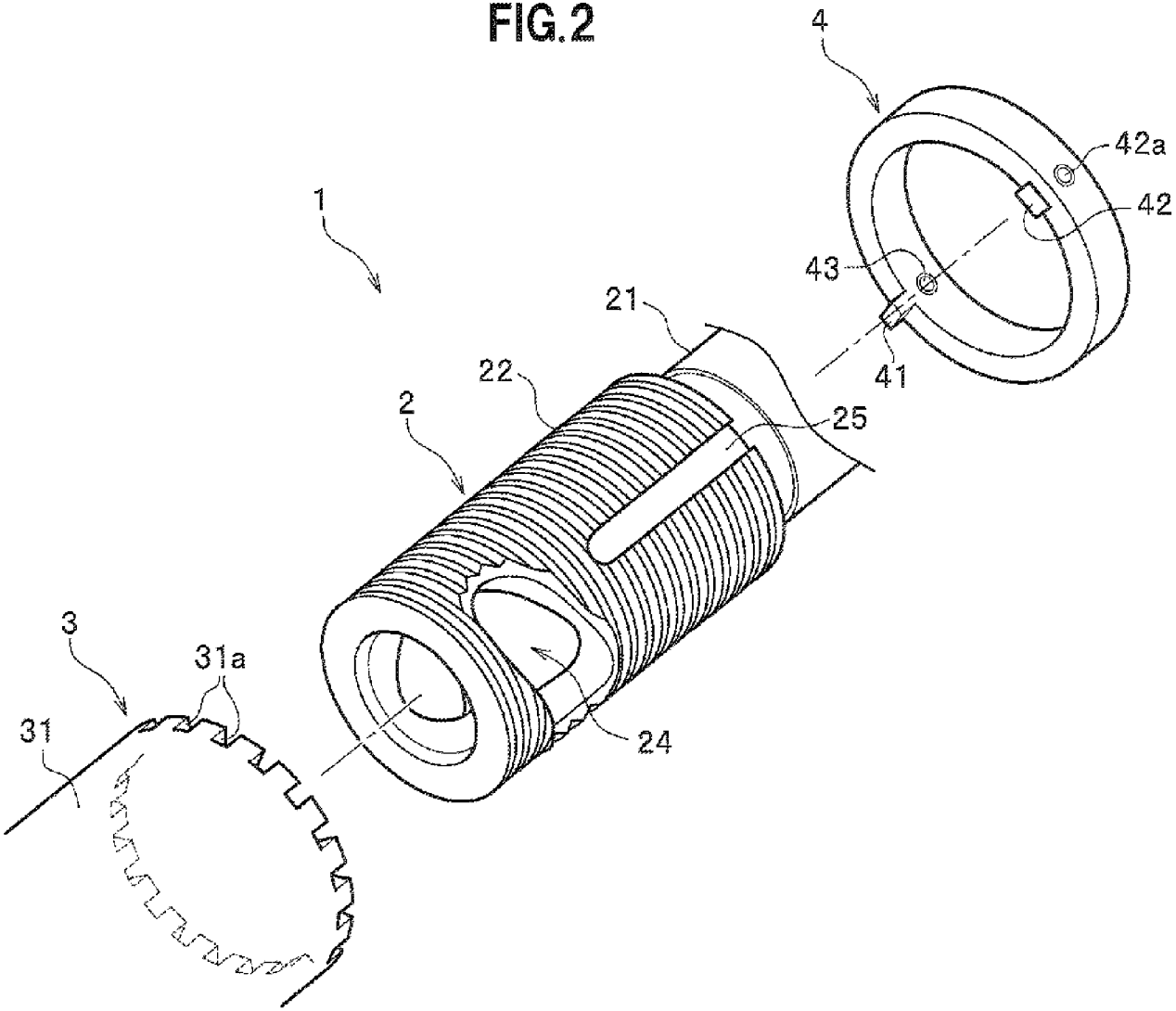
FIG. 2 is an exploded perspective view showing the structure around an adjustment ring and a shank according to the embodiment of the present invention.

The shank 2 is a hollow cylindrical member, and has a small diameter portion 21, a large diameter portion 22, a lead groove 24 (refer to FIG. 2), and an axial direction groove 25 (refer to FIG. 2). The small diameter portion 21 has a shape and a size capable of being attached to a processing machine (not shown). The large diameter portion 22 is a hollow cylindrical shape portion on which an outer thread portion 23 is formed. The lead groove 24 is formed spirally in a front side portion of the large diameter portion 22. The axial direction groove 25 is formed in a rear side portion of the large diameter portion 22.

Note that, in the present embodiment, the small diameter portion 21 and the large diameter portion 22 are formed integrally, but the present invention is not limited to this. Each may be formed individually to be connected to each other. Furthermore, a front end portion (hollow cylindrical shape portion) of the large diameter portion 22, in which front end portion the lead groove 24 is formed, may be formed separately out of the large diameter portion 22.

The housing 3 has a housing body 31, a housing nut 32, a bearing 33, and a spring 34. The housing body 31 is connected to the shank 2. The housing nut 32 is screwed with the front end portion of the housing body 31 to be fixed. The bearing 33 supports the frame 5 so as to be capable of rotating, and is held between the rear end surface of the frame 5 and the front end surface of the housing body 31. The spring 34 intermediates between the housing nut 32 and the frame 5 so that the spring 34 urges the frame 5 to the bearing 33. And the spring 34 urges the frame 5 rearward via a thrust ring and a stop ring 34*b* engaged with the outer portion of the frame 5 at the rear end of the spring 34, while the spring 34 urges the front end portion of the housing nut 32 forward via a thrust ring 34*a* at the front end of the spring 34.

The housing body 31 is equipped with a plurality of recessed portions 31*a* (refer to FIG. 2), an outer thread portion 31*b*, and an inner thread portion 31*c*. The plurality of recessed portions 31*a* are formed at the rear end portion of the housing body 31 as cutouts, and arranged in the circumferential direction of the housing body 31. The outer thread portion 31*b* is formed on the front end outer surface portion of the housing body 31. The inner thread portion 31*c* is formed on the inner surface portion of the housing body 31. One of the recessed portions 31*a* is engaged with a hook portion 41 (refer to FIG. 2) of the adjustment ring 4. The outer thread portion 31*b* is screwed with the housing nut 32. The inner thread portion 31*c* is screwed with the outer thread portion 23 of the shank 2.

Thus, the housing nut 32 is fixed to the housing body 31 via the outer thread portion 31*b*. The inner thread portion 31*c* of the housing body 31 is screwed with the outer thread portion 23 of the shank 2, so that the housing body 31 can be moved along the axis of the shank 2 while rotating relative to the shank 2.

The housing nut 32 is a member to support the frame 5 so as to be capable of rotating. The housing nut 32 supports the frame 5 so as to be capable of rotating via the bearing 33 while urging the frame 5 rearward via the spring 34.

As shown in FIG. 2, the adjustment ring 4 has a ring shape, and is equipped with the hook portion 41, a slide key 42, and a fixing screw 43 (refer to FIG. 1). The hook portion 41 formed on the front end surface of the adjustment ring 4 is engaged with one of the recessed portions 31*a* formed at the rear end portion of the housing body 31. The slide key 42 is disposed at the inner surface portion of the adjustment ring 4 at a position 180 degrees apart from or opposite to the hook portion 41. The fixing screw 43 is a screw to fix the adjustment ring 4 to the shank 2. The slide key 42 is fixed to the adjustment ring 4 with a pin 42*a*.

The adjustment ring 4 can slide in the axial direction of the shank 2 in the state of engaging the slide key 42 with the axial direction groove 25 formed in the large diameter portion 22 of the shank 2.

Accordingly, the housing body 31 is a little rotated while sliding the adjustment ring 4 in the state of engaging the slide key 42 with the axial direction groove 25, so that the hook portion 41 can be engaged with one of the recessed portions 31*a* of the housing body 31. Thus, the adjustment ring 4 can set a relative position between the shank 2 and the housing 3 (the housing body 31 and the housing nut 32) in the front-rear direction, and connect the shank 2 and the housing 3 so as to be capable of integrally rotating.

As shown in FIG. 1, the frame 5 is configured so that the plurality of tapered rollers 51 are arranged along the circumference of a cylindrical front end portion of the frame 5 to be capable of coming out and retracting.

Each of the tapered rollers 51 has the tapered shape in which the front end side is enlarged, and the rear end side is shrunk. Each tapered roller 51 is pressed onto an inner surface of a workpiece (not shown) in the state of being supported on the outer surface of the mandrel 6. And in this state of being pressed, each tapered roller 51 is moved in the circumferential direction on the outer surface of the mandrel 6 (revolution round the mandrel 6), that is, on the outer surface of the front end portion of a first mandrel 61 while being rotated (rotation on its axis), so that burnishing the inner surface of the workpiece is performed. Note that, a diameter of a virtual circle in which the plurality of tapered rollers 51 are inscribed is called a tool diameter δ. Furthermore, the tool diameter δ is generally set to be larger by 10 to 40 μm than the inner diameter of a workpiece. When quantity to burnish is to be increased, the tool diameter δ is set to be larger.

The mandrel 6 has the first mandrel 61 like a rod disposed on the front side, and a second mandrel 62 like a cylindrical tube connected to the first mandrel 61. An outer thread portion 61*a* formed on the rear portion of the first mandrel 61 is screwed with an inner thread portion 62*a* formed inside the front portion of the second mandrel 62, and then a connecting nut 63 is fastened, so that the first mandrel 61 and the second mandrel 62 are connected together to enable to integrally rotate.

The tapered portion 61*b* is formed on the front end portion of the first mandrel 61, which portion 61*b* is matched to the tapered shape of each of the tapered rollers 51. A pin member insertion hole 62*b* is formed in the middle portion of the second mandrel 62 in the axial direction, and goes through in the direction orthogonal to the axial direction. Furthermore, a guide hole is formed inside the rear end portion of the second mandrel 62, which portion a spring 82 of a biasing unit is attached to.

<Tool Diameter Adjustment Mechanism>

A tool diameter adjustment mechanism is a mechanism to adjust the tool diameter δ by moving the frame 5 in the axial direction relative to the mandrel 6. When the tool diameter δ is adjusted, first the fixing screw 43 of the adjustment ring 4 is loosened, then the adjustment ring 4 is slid rearward to release the engagement between the hook portion 41 and one of the recessed portions 31*a*, so that the housing 3 can be moved in the axial direction relative to the shank 2 while being rotated.

The frame 5 supported by the housing 3 via the bearing 33, the spring 34 and so on is moved rearward relative to the mandrel 6 because the spring 34 and so on push the frame 5 rearward when the housing 3 is moved in the direction facing the shank 2, that is, rearward, so that the tool diameter δ can be enlarged along the tapered portion 61*b* of the first mandrel 61. Furthermore, the frame 5 supported by the housing 3 via the bearing 33, the spring 34 and so on is moved forward because the intermediated bearing 33 pushes the frame 5 forward when the housing 3 is moved in the direction going away from the shank 2, that is, forward, so that the tool diameter δ can be shrunk along the tapered portion 61*b* of the first mandrel 61.

<Tool Diameter Following Mechanism>

The tool diameter following mechanism 8 is a mechanism by which the pressing force at the time of processing a workpiece (not shown) is properly and automatically adjusted to balance the torque of the rotational load against the axial force of the mandrel 6, so that a smooth super-precision processed surface is made, even in the case where there is a variation of inner diameters of workpieces or there is a small taper rate of an inner surface of a workpiece.

The tool diameter following mechanism 8 has the lead groove 24 (refer to FIG. 2), a pin member 81, the pin member insertion hole 62*b*, the spring 82, a bearing 83, and a screw 84 having a hexagon hole. The lead groove 24 is formed spirally in the large diameter portion 22 of the cylindrical shape portion formed on the front end side of the shank 2. The pin member 81 is disposed so as to be capable of moving along the lead groove 24. The pin member insertion hole 62*b* is formed in the second mandrel 62. The spring 82 is installed in the shank 2, and is a biasing unit biasing the second mandrel 62 forward. The bearing 83 prevents the spring 82 from being twisted. The screw 84 is a biasing force adjusting tool to adjust the biasing force of the spring 82.

The pin member 81 has a cylindrical hollow pin 81*a*, bolts 81*b* each of which has a hexagon hole, and bearings 81*c*. The cylindrical hollow pin 81*a* is inserted in the pin member insertion hole 62*b* formed in the second mandrel 62. The bolts 81*b* are attached to the respective end portions of the cylindrical hollow pin 81*a*. The bearings 81*c* are also attached to the respective end portions of the cylindrical hollow pin 81*a*.

Each bearing 81*c* is attached so that an outer ring thereof can be guided along the lead groove 24 (refer to FIG. 3A), and is positioned between the outer surface of the second mandrel 62 and a corresponding bolt 81*b*.

Next, operation of the tool diameter following mechanism 8 of the roller burnishing tool device 1 according to the embodiment of the present invention will be described with reference to FIGS. 3A to 3C.

Figure 3A:
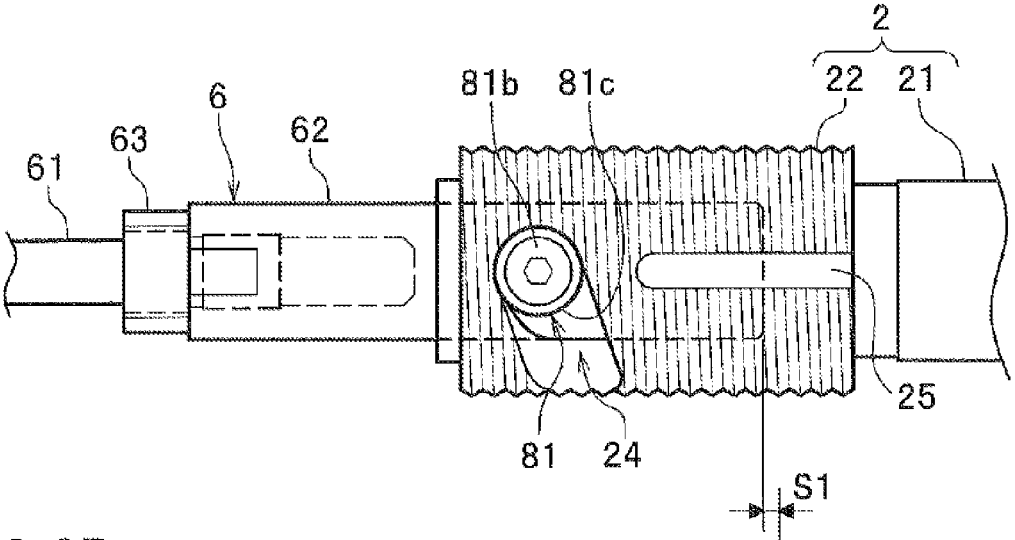
FIG. 3A is a plan view to explain a state, before processing, of a tool diameter following mechanism according to the embodiment of the present invention.
Figure 3B:
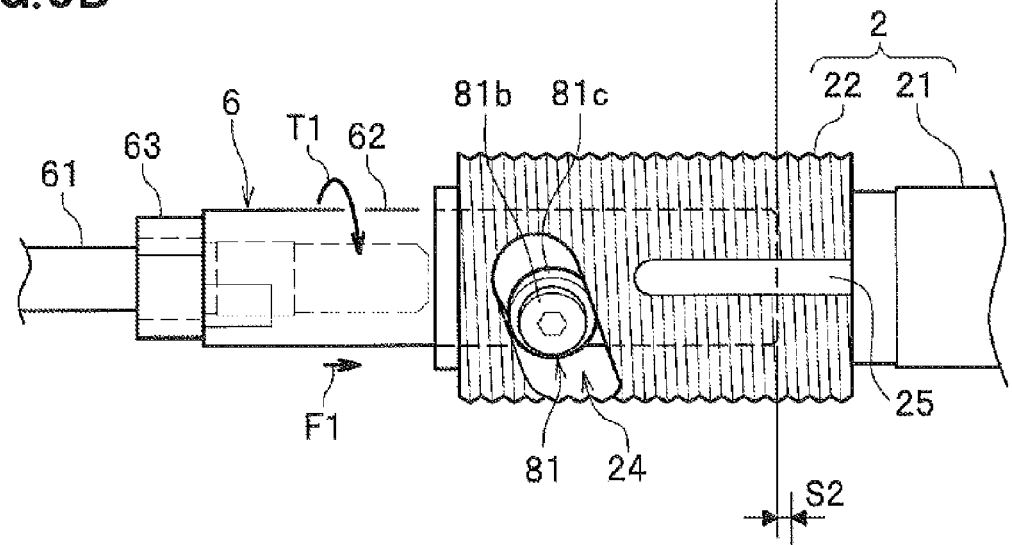
FIG. 3B is a plan view to explain an operation, in processing, of the tool diameter following mechanism according to the embodiment of the present invention, in which state a mandrel has been retreated relative to the position in FIG. 3A.
Figure 3C:
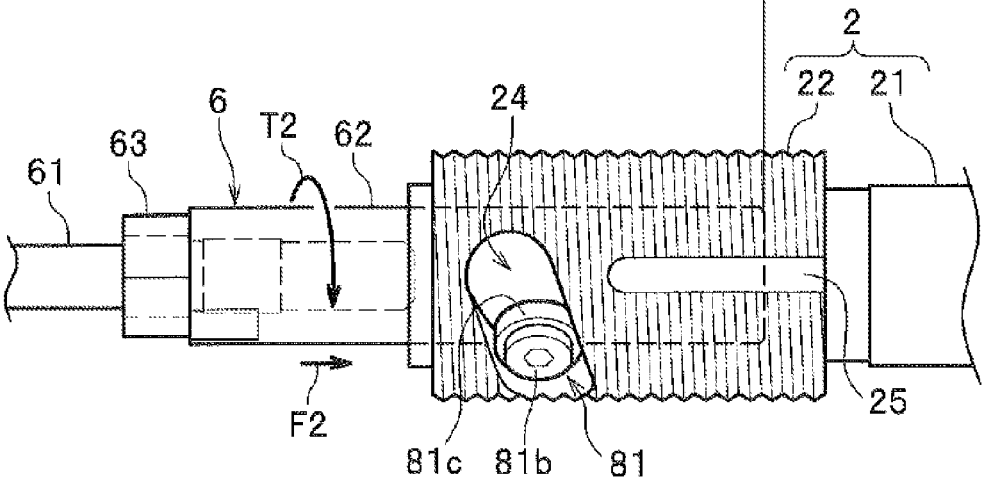
FIG. 3C is a plan view to explain the operation, in processing, of the tool diameter following mechanism according to the embodiment of the present invention, in which state the mandrel has been retreated relative to the position in FIG. 3B.

FIGS. 3A to 3C are plan views for explaining the operation of the tool diameter following mechanism 8. FIG. 3A shows a state before processing. FIG. 3B shows a state in the processing, in which state the mandrel 6 has been retreated by S1 in the axial direction relative to the position in FIG. 3A because excessive load torque T1 acts on the mandrel 6 in the processing. FIG. 3C shows a state in the processing, in which state the mandrel 6 has been further retreated by S2 in the axial direction relative to the position in FIG. 3B because more excessive load torque T2 than that in the state of FIG. 3B acts on the mandrel 6 in the processing.

The roller burnishing tool device 1 according to the embodiment of the present invention is rotated after attaching the shank 2 to a processing machine not shown, so that the driving torque is transmitted to the mandrel 6 from the shank 2 via the tool diameter following mechanism 8. Burnishing is performed while rotating the mandrel 6 in the state of pressing the rollers 51 onto an inner surface of a workpiece (not shown). In the case where there is a variation of an inner diameter of an inner surface of a workpiece, an excessive load torque T1 acts on the mandrel 6 and an axial component force F1 is caused in processing.

The axial component force F1 forces the mandrel 6 to move rearward in the axial direction against the biasing force of the spring 82. That is, the pin member 81 is moved together with the mandrel 6 along the lead groove 24. Thus, the mandrel 6 is retreated together with the pin member 81 in the axial direction while being rotated relative to the shank 2 (refer to FIG. 3B). Therefore, the axial force F1 reduces the excessive pressing force in the burnishing to automatically adjust the excessive pressing force to a proper pressing force.

As shown in FIG. 3C, it is similar even in a case where the mandrel 6 is retreated further by S2 in the axial direction by acting of more excessive load torque T2. An axial component force F2 is larger than the axial component force F1.

Because the roller burnishing tool device 1 according to the embodiment of the present invention is equipped with the tool diameter following mechanism 8, the pressing force in burnishing can be automatically adjusted by balancing the torque of the rotational load against the axial force of the mandrel 6. Therefore, a smooth super-precision processed surface can be made. Furthermore, the range of following up of the tool diameter δ can be properly set by appropriately setting the twist angle (lead quantity) of the lead groove 24 in accordance with specifications of the roller burnishing tool device.

In the roller burnishing tool device 1 according to the embodiment of the present invention, the tool diameter following mechanism 8 is constituted by connecting the shank 2 and the mandrel 6 with the pin member 81 disposed so as to be capable of moving along the spiral lead groove 24 formed in the front end portion of the shank 2. Thus the tool diameter following mechanism 8 can be housed inside the shank 2. Therefore, the outer diameter of the housing 3 can be made smaller, so that the roller burnishing tool device 1 can be downsized.

Thus the roller burnishing tool device 1 according to the embodiment of the present invention can be easily handled and improve the operability. And a range where the roller burnishing tool device 1 is adapted, is enlarged and the roller burnishing tool device 1 can be properly used for various processing machines. Furthermore, there is no necessity to dispose flexible rollers in the housing 3, so that the housing 3 can be simplified to reduce the numbers of parts and consumables, and to improve assembly and disassembly performance.

<Assembly and Disassembly Performance>

How to assemble and disassemble the roller burnishing tool device 1 according to the embodiment of the present invention will be explained mainly with reference to FIG. 1.

First, the housing nut 32 is loosened to be removed together with the spring 34 from the housing body 31. Then the frame 5 can be removed together with the tapered rollers 51. At this time, the bearing 33 is also removed.

After the connecting nut 63 is loosened, the first mandrel 61 can be removed from the second mandrel 62 by rotating the first mandrel 61. After loosening the fixing screw 43, the adjustment ring 4 can be removed by moving the adjustment ring 4 in the axial direction along the axial direction groove 25. Thus after the adjustment ring 4 is removed, the housing body 31 can be rotated. So the housing body 31 is removed by rotating the housing body 31 relative to the shank 2.

Regarding how to disassemble the tool diameter following mechanism 8, first, the pin member 81 is disassembled to be removed. Regarding how to disassemble the pin member 81, after the bearing 81*c* is removed by loosening the bolt 81*b* having the hexagon hole, the cylindrical hollow pin 81*a* is removed out of the pin member insertion hole 62*b* of the second mandrel 62.

Then since the second mandrel 62 can be pulled out of the shank 2, the spring 82 and the bearing 83 are also removed together.

In such a manner, the roller burnishing tool device 1 according to the embodiment of the present invention can be easily disassembled. Note that, since the way how to assemble the device 1 is the reverse of disassembling the device, an explanation for assembling is omitted. The roller burnishing tool device 1 according to the embodiment of the present invention can be easily handled and easily disassembled, so that maintenance performance is good.

In the above, the embodiment of the present invention has been described, but the present invention is not limited to the embodiment and can be carried out by appropriately modifying the embodiment.

For example, the embodiment is a single row roller type embodiment that the rollers 51 are disposed around the front end portion of the mandrel 6. But the present invention is not limited to this, and may be configured to be a double row roller type embodiment that another set of rollers (not shown) having a tool diameter different from the rollers 51 is disposed behind the rollers 51.

DESCRIPTION OF REFERENCE NUMERALS

1 Roller burnishing tool device
2 Shank
3 Housing
4 Adjustment ring
5 Frame (Roller support member)
6 Mandrel
8 Tool diameter following mechanism
22 Large diameter portion (Hollow cylindrical portion)
24 Lead groove
25 Axial direction groove
31 Housing body
32 Housing nut
33 Bearing
34 Spring
51 Roller
61 First mandrel (Mandrel)
61*a* Outer thread portion
61*b* Tapered portion
62 Second mandrel (Mandrel)
62*a* Inner thread portion
62*b* Pin member insertion hole
81 Pin member
82 Spring (Biasing unit)
83 Bearing
F1 Axial component force
F2 Axial component force
T1 Load torque
T2 Load torque

What is claimed is:

1. A roller burnishing tool device comprising:

a shank configured to be attached to a processing machine;

a housing connected to the shank in a manner so as to be rotatable together with the shank, a connected position of the housing relative to the shank being adjustable in a front-rear direction;

a roller support member having an annular shape in a cross section thereof, the roller support member supported on the housing so as to be capable of rotating relative to the housing, and disposed so as to follow a movement of the housing in a case where the connected position of the housing relative to the shank is adjusted to be changed in the front-rear direction;

a plurality of rollers having tapered shapes and supported by the roller support member;

a mandrel having a tapered portion matched with the tapered shapes of the plurality of rollers and coaxially inserted in the roller support member; and a tool diameter following mechanism connecting the shank and the mandrel, the tool diameter following mechanism including:

a hollow cylindrical portion formed at a front portion of the shank, a lead groove formed spirally in the hollow cylindrical portion, the lead groove being configured to pass through the hollow cylindrical portion, a pin member insertion hole formed in the mandrel, a pin member inserted in both the pin member insertion hole and the lead groove so as to be capable of moving spirally along the lead groove, and a biasing unit attached to the shank and biasing the mandrel forward.

2. The roller burnishing tool device according to claim 1, further comprising a biasing force adjusting tool to adjust biasing force of the biasing unit.

3. The roller burnishing tool device according to claim 2, wherein the biasing force adjusting tool comprises a screw.

* * * * *